United States Patent [19]

Hübner

[11] 4,314,314

[45] Feb. 2, 1982

[54] ELECTRICALLY ILLUMINATED MIRROR

[76] Inventor: Otto Hübner, Mauerkircher Strasse 199, Herzog Park, 8000 Munchen 81, Fed. Rep. of Germany

[21] Appl. No.: 155,129

[22] Filed: May 30, 1980

[51] Int. Cl.[3] ..... F21V 7/04

[52] U.S. Cl. ..... 362/32; 362/135; 362/142

[58] Field of Search ..... 362/135, 32, 142

[56] References Cited

U.S. PATENT DOCUMENTS 2,145,462 1/1939 Speck ..... 362/136

*Primary Examiner*—Stephen J. Lechert, Jr.
*Attorney, Agent, or Firm*—Norman Lettvin

[57] ABSTRACT

An illuminated mirror device is provided as an aid to application of cosmetics. The mirror device provides two mirror-carrying wings that are pivotable between an open planar position and a closed, cassette-like, construction that conveniently provides the mirror device with character as a travel appliance. Pivoting of the wings is about a translucent tube that surrounds an electrically energized source of illumination, and which tube transmits light to the wings which, by reason of their character, guide light therethrough to the free edges of the wings from where illumination is directed toward the object that is to be seen in the mirrors. The wings are provided with inclined border surfaces from which light is reflected toward the object to be illuminated. Accessories include: a pivotable second tube, concentrically within the translucent tube, for selectively changing the quality of the light transmitted therethrough from the light source; a support for the mirror device to make it free standing; and a light conducting rod, that when mounted on the translucent tube operates to selectively direct a spot of light from the light source against the object being examined in the mirrors.

10 Claims, 9 Drawing Figures

ELECTRICALLY ILLUMINATED MIRROR

FIELD OF THE INVENTION

The invention relates to an electrically illuminated mirror that is to be used as a standing mirror or as a wall mirror, primarily, however, as a hand mirror.

BRIEF SUMMARY OF THE BACKGROUND OF THE INVENTION

With mirrors, the attainable mirror effect depends decisively on the illumination of the person or object to be reflected. The illumination should be free of glare and is to bring about a lighting, as uniform as possible, of the object to be mirrored, which can best be achieved by an indirect illumination.

Relatively large round mirrors, used by women in applying cosmetics, are known in the art, and are obtainable on the market. In such mirror forms it is a usual practice to arrange an annular fluorescent lamp or an incandescent bulb rearwardly of the mirror and to direct the light forwardly in the direction of the object to be mirrored from a matte frame that surrounds the mirror glass. In these known arrangements, however, there occur relatively great losses of light.

A serious drawback of such known forms of mirror execution lies in the fact that they are large and unwieldy. Thus, as wall mirrors and/or standing mirrors, they are unsuitable as an appliance for travel.

Illuminated mirrors are also known which, by means of tinted filters simulate daylight or night light, since it is well known that a make-up applied in daylight presents an effect different from make-up applied at night, and vice versa. Also, to effect these forms of mirror execution requires matters of complicated constructions in wall mirrors and stand mirrors.

PRELIMINARY DESCRIPTION OF THE INVENTION

Underlying the instant invention requires an appreciation of the fact that, in general, only a moderate brightness, without glare, is sufficient to illuminate in detail the object, such as the face.

Thus, it is a principal object of this invention to find a technical solution that makes it possible to provide a hand mirror in an esthetic form that is suitable for a cosmetic set.

From this desired end there arises the problem of providing a hand, or wall or stand mirror of the type mentioned at the outset, which is constructed to provide an optimal utilization of the light source therefor, with glare-free indirect illumination of the object, and with further object to make possible a mirror with local concentration of the illuminating strength, which presents in the simple construction a day or night filter, and which is of esthetcally attractive form and is so sturdy and handy that it is usable as a traveling mirror.

The problem is resolved and the objects attained in the instant invention, whose operation will now be described.

A part of the problem posed is solved according to the invention by the means that about a centrally arranged, matted or translucent tube, which surrounds a light source, two light-conducting frames, or bodies, are pivotably arranged to swing like wing doors, with said light-conducting bodies being constructed, adjacent their outer peripheral edges, at an incline preferably of 45° in the direction toward the viewer, and on each of the doors is mounted a mirror, a flat reflecting mirror on one wing, and a magnifying mirror on the other wing, with the mirror in each wing extending substantially to the inner edge of said inclined reflective border.

The light-conducting bodies, preferably formed of Plexiglass, have their edges arranged to face and lie adjacent the translucent tube, and present along their entire length, adjacent the translucent tube, a concave thickening, so that the light from the light source is largely radiated into this thickening and is guided by means of internal reflection of the material to the free edges of the light-conducting body and there appears free of glare and directed toward the viewer.

A still greater yield of light is achieved according to this invention by the means of construction such that the light radiating past the concave thickening of the light-conducting bodies impinges directly upon the angled peripheral surfaces of the bodies and is reflected from there onto the viewer.

In the advantageous development of this invention, the angled peripheral edges present on their reflective surface, ribbings or frosting, so that the reflected light is radiated more diffusely toward the object.

Likewise the light from the light source is caused to pass through matted tube forms to further diffuse and provide glare-free light, so that an optimal utilization of the light is ensured.

The wing doors of the mirror are hingeable, by means of a swinging mechanism to move together to close, or to be moved apart to open, about the matted tube that serves as a light-conducting body. Below the wing doors, the matted tube is extended to form a handle, in which there are accommodated a lamp fixture, switch, cable, etc., as disclosed hereinafter.

In consequence of the great light yield from the light source, it is economically supportable to feed the light source (for example an incandescent lamp) from a battery or an accumulator, which, in the mirror according to this invention, may be located and accommodated in the handle.

According to a further feature of the invention, the mirror construction includes a second tube, which is arranged concentrically inside the matted tube to surround the light source. This second tube has one arcuate part that extends along the length of the tube that is crystal clear, while another longitudinal arcuate part is dyed in a different color, but in such a way that light from the light source can emerge through the dyed portion to the outside. By means of a rotary construction arranged in the handle, the second tube is selectively rotatable about its longitudinal axis. It is well known that make-up applied in daylight has another effect in the evening and vice versa. The rotatable, dyed tube, therefore, simulates, according to the color setting chosen, daylight or the light of evening.

A further part of the problem posed at the outset is solved according to a modified form of this invention by a means, that is provided on the end of the matted tube opposite the handle, in the form of a detachable, swingable, elongated, angled light-guide bar, with one end surface facing the light source, which light-guide bar serves the purpose of directing a part of the light in spot, or point, form onto the object to be mirrored. The light-guide bar is expediently formed, at its end which faces the light source, as a concaved surface, and on its end which faces the object as a straight light emitting surface. The light-guide bar may be detachably joined to the tube by a bracket in which said bar is selective swingably arranged. The light-guide bar according to this invention is arranged directly above the light source so that it is exposed only to white light, which then in great brightness is radiated in spot form upon the object.

It is further provided according to the invention that the end of the bar facing the light source is provided with a device with the aid of which the light source (preferably an incandescent lamp) can be screwed out of, or introduced into, its support.

Of special importance in this invention is the concept that the mirror can be used as a travel mirror. It is therefore kept small and elegant in its dimensions.

Since hand mirrors, especially for use on trips, but also at home, are exposed to a certain amount of impact or dropping, it is a further feature of the invention that through simple hinging onto one another of the light-guide bodies about their tubular central axis, the light-guide bodies are shaped to form a closeable cassette, within which the two mirrors are enclosed and protected from breakage. It is further of significance that the volume of the closed mirror is compact and accordingly, is ideal for travel.

A further feature of the invention lies in the fact that the electric cable can be stored especially space-savingly and especially advantageously in the interior of the folded-up light-guide bodies, as it were as if in a cassette. This is especially desirable in connection with a travel mirror, so that through the metal pins of the cable plug no scratches will be caused on the mirror surfaces, and the cable may be advantageously carried in a storage pouch, the material of which is suited for polishing and caring for the mirror surfaces.

A mirror which by its nature serves largely cosmetic purposes must be esthetic in its external form. This invention takes this requirement into account through the choice of the material. In all essential parts, with the exception of some parts in the handle that are rendered invisible by surface treatment of the Plexiglass, the mirror consists of Plexiglass parts, so that there is created the impression of a valuable crystal body. Through surface treatment of the glass there can be achieved various further effects.

The invention also takes into account that, for example, under the mirror there can be inserted inlay sheets with various motifs which show outwardly through the light-guide body of Plexiglass, in the manner of back-of-glass patterns, and give the mirror a special character.

The hand mirror can also be set up by means of a stand bracket hinged in wing-type lugs on the back of the centrally arranged tube. The stand bracket can be easily taken out of its lugs when it is not needed.

In a simplified and thereby cheaper form of execution of the device, a part of the problem initially posed is solved according to the invention that about a centrally arranged, matted, translucent tube that surrounds the light source, two wings consisting preferably of plastic or other light material are pivotably mounted, these wings being angled-off at their edges in the direction of the view, and a normal, plane mirror, being arranged on the one wing and a magnifying mirror on the other wing in each case of a size close to the edge of the angled light reflecting surface on the wing.

This form of execution of the device contains the features as above-described in which the wings are formed as light-guide bodies, with the exception that the light from the light source is not totally guided to the free edges of the light-guide body from whence there emerges light free of glare in the direction of the observer.

An indirect irradiation of light onto the viewer is also achieved by the means that the light impinges upon the angled-off, or inclined, edge surfaces of the wings and is reflected from there onto the viewer.

Further objects of the invention and the advantages thereof set forth above are further explained with the aid of description of a preferred form of construction shown in the accompanying drawings wherein:

DESCRIPTION OF THE PREFERRED EMBODIMENT

Figure 1:
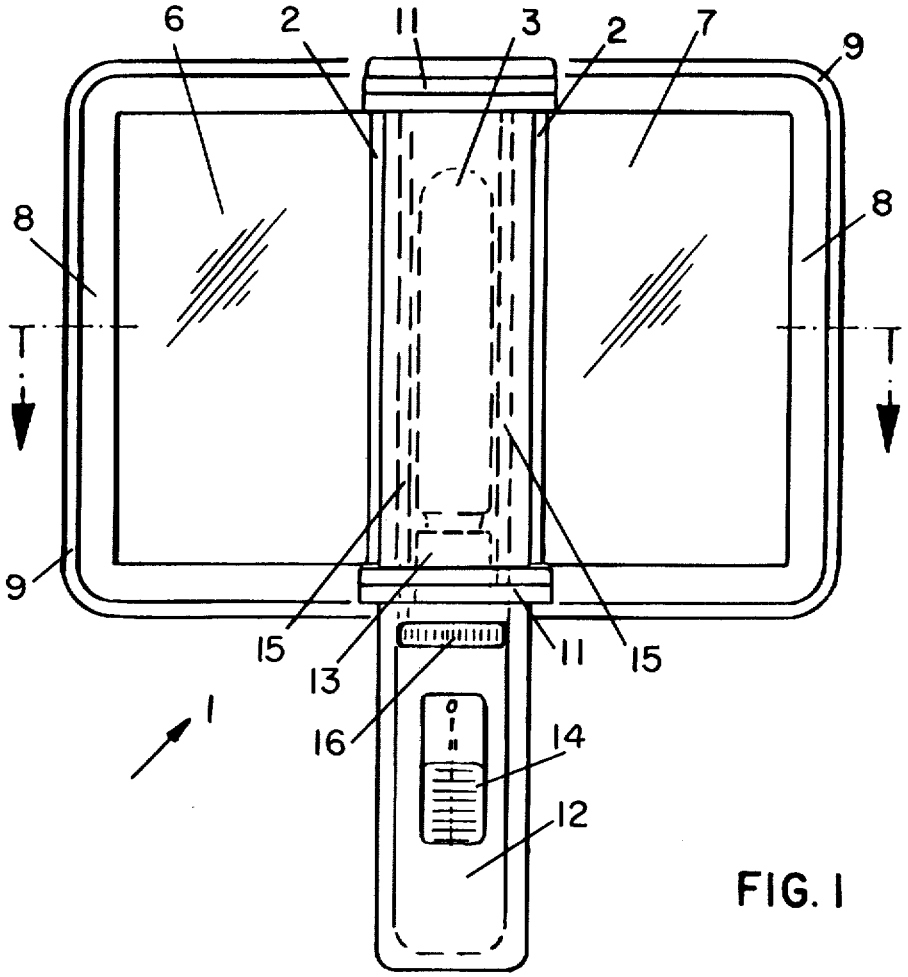
FIG. 1 shows a front elevation of a hand-held foldable mirror, constructed in accord with the invention and showing the two leaves, or wings, of the mirror deployed in open position.

Referring now to the drawings, FIG. 1 shows a hand mirror according to the invention, generally indicated at 1, with its folded-open, movable, frame members or wings 4 and 5 which are dished and respectively carry mirrors 6 and 7 facing the viewer. One mirror 6 may be in the form of a plane mirror, while the other mirror 7 may be, as shown in FIG. 2, a curved mirror for magnifying effect.

An outermost elongated tube 2, about whose longitudinal axis the frame portions move between open position (FIG. 1) and folded-closed position (FIG. 3), surrounds an inner, rotatable, tube 15, illustrated by broken lines in FIG. 1, which is provided with longitudinal, arcuate, sections of different color. The inner tube 15 surrounds an elongated light bulb 3 that is the source of illuminating light.

Element 11 designates ring portions carried by the wing doors 4 and 5 that serve as part of the pivoting mechanism by means of which the movable wing members 4 and 5, which are especially constructed as light-guide bodies and carry the mirrors 6 and 7, are swingable about the longitudinal axis of outer tube 2 which serves as the journal for said ring portions.

Figure 2:
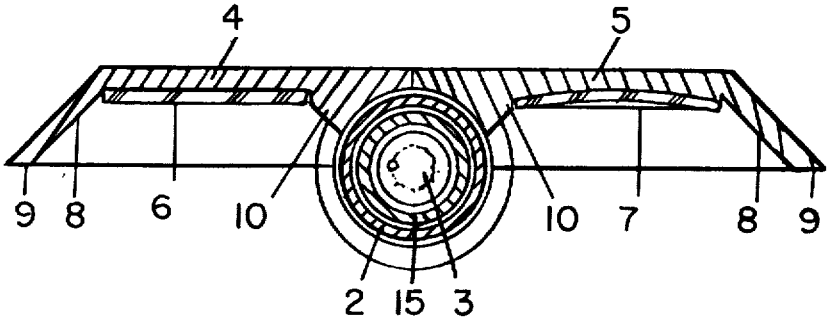
FIG. 2 is a cross-sectional view taken substantially on the section line of FIG. 1.
Figure 4:
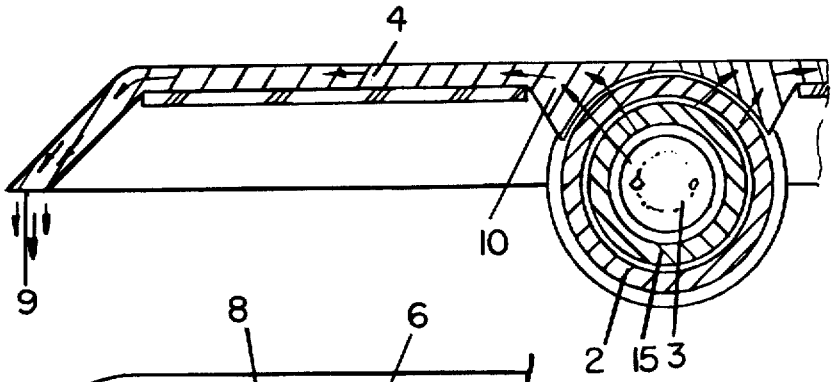
FIG. 4 is a fragmentary, enlarged view, similar to FIG. 2, but illustrating the path of the light rays transmitted from the light source through the light-guide body.
Figure 6:
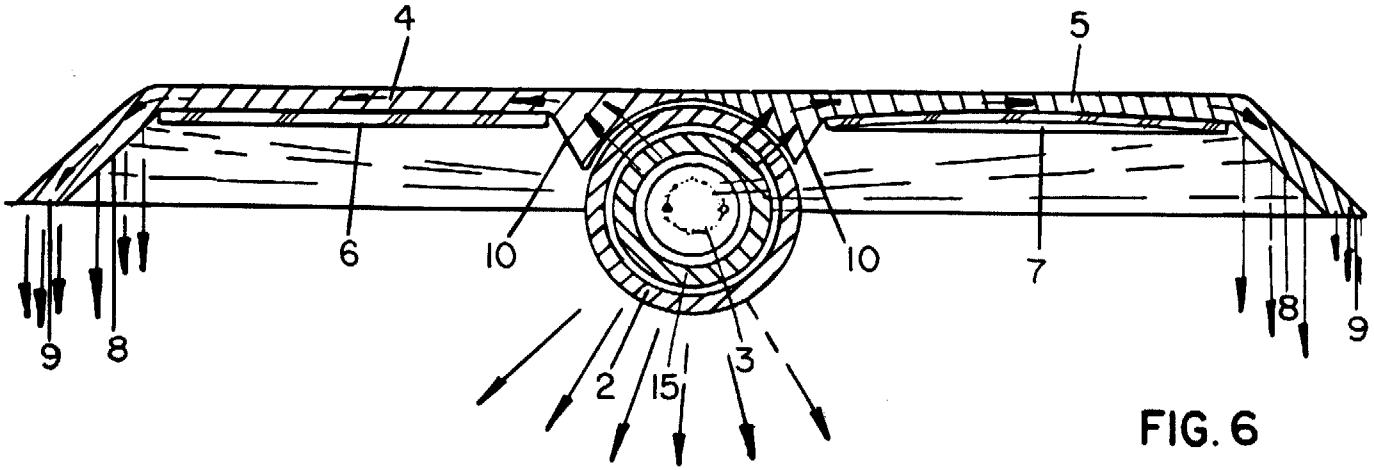
FIG. 6 is an enlarged view of the construction of FIG. 2, illustrating multiple paths of light beams emanated from the source of illumination for the mirror.

When the frame members 4 and 5 are in the open position, as shown in FIGS. 2, 4 and 6, the tube 2 which is of matted translucent material is positioned to project forwardly relative to mirrors 6 and 7, that are illustrated in FIG. 6. Light then passes through the wall of tube 2 that lies closely adjacent the arcuate, concave portions, of wing members 4 and 5, to enter the wings through said concave portions. The concave portions are located rearwardly from walls 10, that are inclined at 45° to the wing portions that support the mirrors. Thus, the light is channelled through the light-guide bodies 4 and 5, from where the light is indirectly radiated toward the viewer from the free edges 9.

Figure 3:
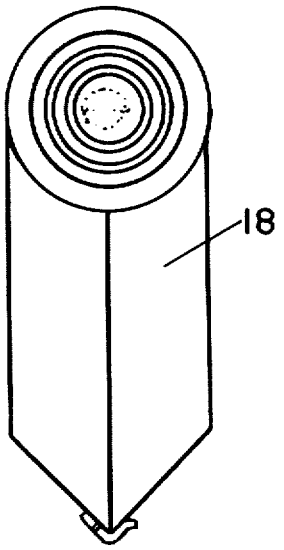
FIG. 3 is an illustrative plan view of the construction seen in FIG. 2 with the leaves closed, and with a lock feature applied.

The shape of the frame members or wings 4 and 5 permits those parts to be swung with respect to one another in such a way that they form the closable, compact, cassette 18 generally shown in FIG. 3, which is hollow to also serve for the storage of a cleaning cloth, and an electric cable (not shown) for energizing the light source, bulb 3. The portions of doors 4 and 5, which terminate at the ends of inclined walls 10, abut when the doors 4 and 5 are closed, thus limiting forces applied to the mating outer edges 9 of the wings 4 and 5 when they are closed as seen in FIG. 3.

Numeral 12 designates a tubular handle that is provided by a downward extension of tube 2. The handle 12 houses electrical switching elements for the light source 3, and the surface of handle 12, which is preferably of Plexiglass, is treated in such a way that the internal electrical switching elements, as well as the cable attachment, are not externally visible. On the handle 12 there are arranged an on-off switch 14 for the light source 3, and a knurled wheel 16, accessible through an aperture in tube-handle 12 and with the aid of which the inner tube 15 is selectivey pivotable about its longitudinal axis. Reference numeral 13 (FIGS. 1 and 9) designates the screw-threaded lamp base for receiving the light element 3, which preferably is an incandescent lamp.

FIG. 2 shows a plan view of the mirror shown in FIG. 1, seen at the section line illustrated on the drawing of FIG. 1. In FIG. 2, the reference numerals 10 designate inner sides of the thickenings that are formed concave along their axial length, concentric of the longitudinal axis of tube 2, and into which light from the light source 3 enters when the frame portions 4 and 5 are constructed as light-guide bodies, and from which the light of the light source 3 emerges at 9 as an illuminating frame, as seen in FIGS. 3 and 6, facing in the direction of the viewer. Alternatively, or conjunctively, and as seen in FIG. 6, light from source 3 may be radiated, or beamed, to impinge on the reflective, 45° inclined, surfaces 8 of the frame (FIG. 6) and from there are reflected onto the viewer.

Figure 5:
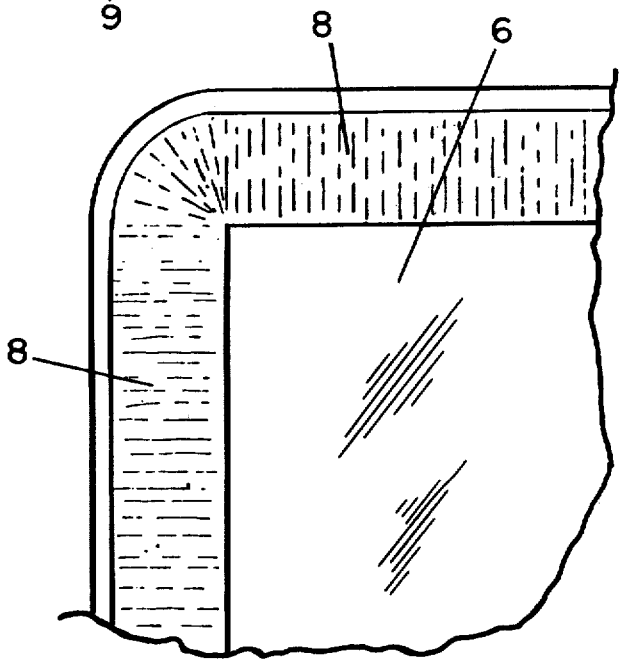
FIG. 5 is a fragmentary, enlarged view of a corner of the edge portion of the light-guide body shown in FIGS. 1 and 2.

As FIGS. 5 and 6 show, the inclined surfaces of the frame 8, which are at an angle facing the viewer, are preferably ribbed in order to generate a diffuse light.

FIG. 4 shows the incidence of light from source 3 into the wing member, 4 or 5, constructed as a light-guide body, and shows the exit of the light from the outer edge surrounding the mirror of the light-guide body as illuminating frame 9.

In FIG. 6 there is represented the entire beam path of the electric hand mirror, in which the frame members 4 and 5 are constructed as light-guide bodies. There is perceived the various beam paths: (a) from the light source through the concave thickening 10 to the emergence in the glare-free illuminating frame 9; (b) from the elongated light bulb 3 radiating past the inclined wall portions 10 to impinge against the inclined surface 8 and from there being reflected glare-free onto the viewer; as well as (c) the light path directly through the matted, translucent, tube 2 forwardly toward the viewer.

Figure 7:
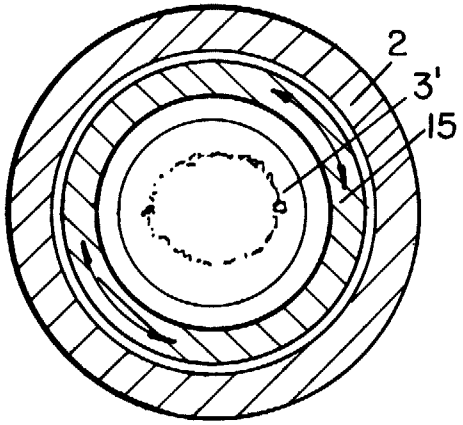
FIG. 7 is an enlarged cross-sectional view of the light source and the surrounding concentric structure, with indication through arrows of rotary movement of the inner tube.

FIG. 7 shows a cross-section through the tubes that are arranged centrally of the mirror, including the outer tube 2, and the inner tube 15 having arcuate color segments arranged longitudinally, concentrically to outer tube 2, with the tube 15 constructed for pivoting movement, and the light source 3 being shown centrally of and spaced from inner tube 15.

Figure 8:
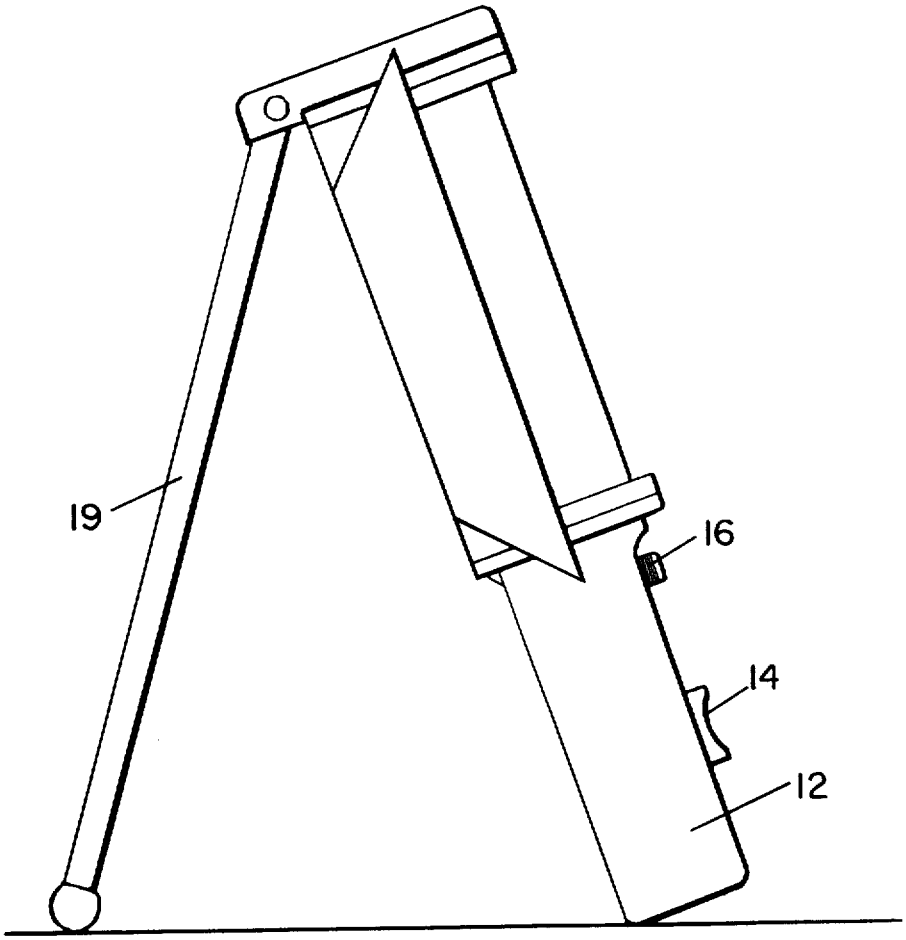
FIG. 8 is a side elevational view illustrating the mirror of FIGS. 1–7 modified to be supported as a stand mirror.

FIG. 8 shows the mirror in a side elevational view, functioning as a standing mirror with the handle 12 serving as a front leg, and a hinged back panel, or stand leg 19 attached to the upper end of the mirror and extending rearwardly of the mirror.

Figure 9:
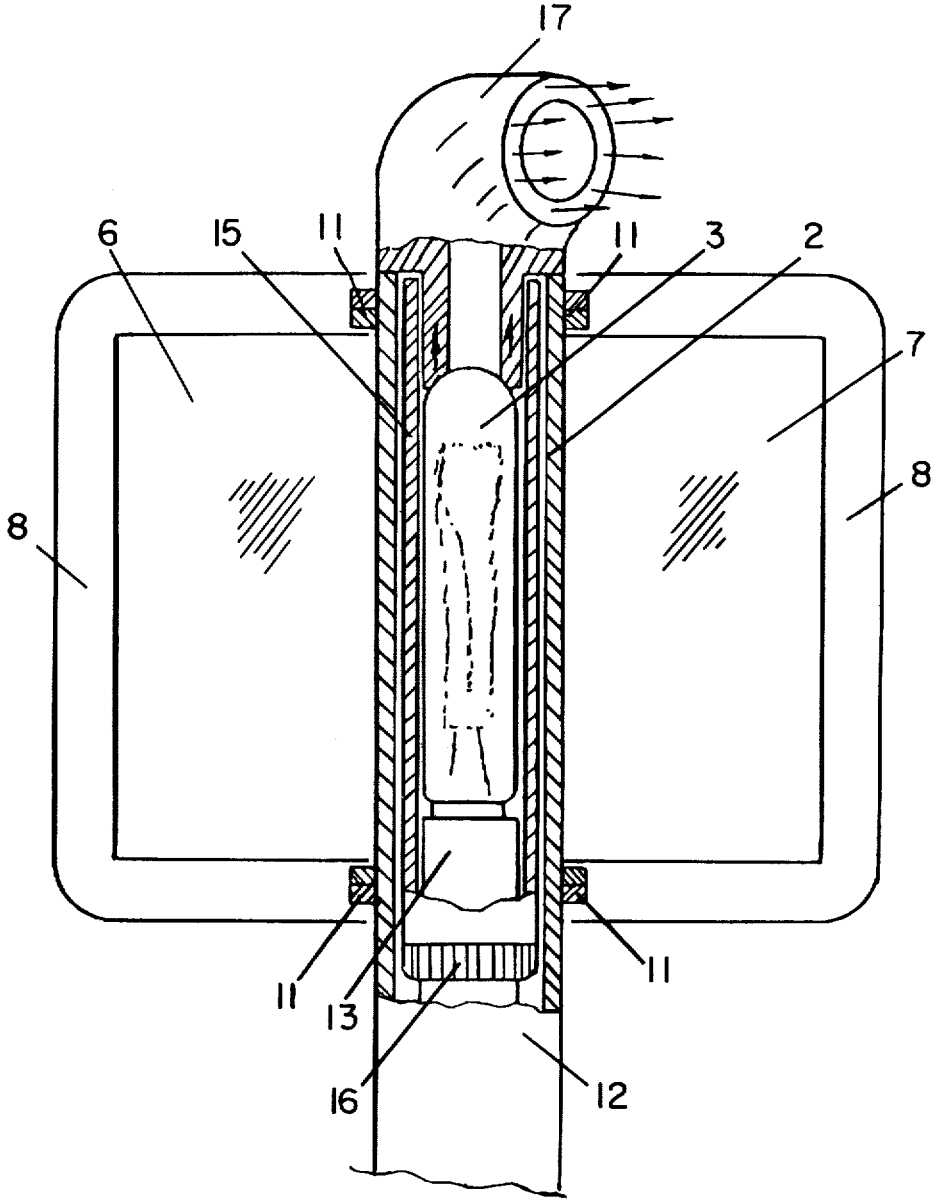
FIG. 9 is a modified form of mirror with an attachment serving as a light-guide to direct light from the light source directionally transversely of the plane of the mirror.

FIG. 9 shows the mirror according to the invention with a selectively pivotable, elongated, curved light-guide bar 17 supported on the upper end of tube 2 and with one end portion thereof having a concave face and located in axial alignment directly facing the light source 3, and with the other end surface constructed as a flat side adapted to face the object to be reflected.

While one form of the invention has been described, it will be understood that the invention may be utilized in other forms and environments, so that the purpose of the appended claims is to cover all such forms of devices not disclosed but which embody the invention disclosed herein.

I claim:

1. In an illuminated mirror device that includes a pair of spaced mirrors each mounted to be selectively pivotable, and an electrically energized source of light for illuminating the person using the pair of mirrors, the improvement comprising, in combination: an elongated translucent tube surrounding an electrically energized source of light;

a pair of dished wings arranged to be selectively pivotable about the longitudinal axis of said translucent tube, and both being swingable between a closed position and an open planar position, a mirror mounted in the dished portion of each wing and exposed for viewing when the wings are in open position; and each wing having light conducting character for guiding light from a region adjacent the translucent tube to the terminal edges of the wing distally from said translucent tube.

2. An illuminated mirror as in claim 1 wherein portions of each dished wing are shaped to provide an inclined reflective border wall, adjacent the terminal edges of the wing, and against which light from the translucent tube is directed to be reflected against the person viewing himself in the mirrors.

3. A mirror as in claim 1 or 2 wherein portions of the wing closest to the translucent tube are thickened with a concave surface adjacent said tube to provide a light-conducting portion for enhanced receiving of light, and for guiding light from the light source to portions of the wing distally from the translucent tube.

4. A mirror as in claim 3 wherein the thickened portions of the wings are constructed to engage when the wings are closed, so as to limit force applied on the distal terminal edges of the wings when the wings are closed.

5. A mirror as in claim 1 wherein a second elongated light conducting tube is located concentrically between the source of light and said translucent tube, said second tube being selectively pivotable about its longitudinal axis, and said second tube being formed of at least two arcuate sections extending along the length thereof and being of different shades to provide light of selective shades for selective illumination of the image being reflected.

6. A mirror as in claim 5 including light conducting rod means for selectively directing a spot of light from the source of light against the image being reflected from the mirrors.

7. A mirror as in claim 1 including means carried by the mirror and serving as a stand adapted for supporting the mirror on a support surface.

8. A mirror as in claim 3 wherein the thickened portions of the wing are of such a size as to not obstruct the radiation of light from the translucent tube against the inclined reflective border walls on the wings, and the translucent tube is matted to provide a glare-free light source radiating light directly toward the image being reflected in the mirrors.

9. In an illuminated mirror device that includes a pair of spaced mirrors each mounted to be selectively pivotable, and an electrically energized source of light for illuminating the person using the pair of mirrors;

the improvement comprising, in combination: an elongated translucent tube surrounding an electrically engergized source of light;

a pair of wings arranged to be selectively pivotable about the longitudinal axis of said translucent tube, and both being swingable between a closed position, where the wings face each other, and an open planar position;

two reflecting mirrors, each of different reflecting character, mounted one each on each of the pair of wings; said pair of wings, when in the closed position, abutting each other to provide a compact mirror device suitable for packing for travel, the mirror on each wing being spaced from the plane of the portion of the wing which abuts the other wing, so that said mirrors are protected from damage when the mirror device is in closed position;

and the wings and translucent tube being constructed and arranged so that the source of light is positioned between the two mirrors when the mirror device is in open position and with the translucent tube exposed to permit light from the light source therewithin to project against a person using the mirror device.

10. A mirror device as in claim 9 including a tubular extension at one end of the translucent tube and separate from the pair of wings, means for electrically energizing the source of light, and an on-off switch for the source of light carried by said tubular extension.

* * * * *